US008109192B2

(12) United States Patent
Carlson et al.

(10) Patent No.: US 8,109,192 B2
(45) Date of Patent: Feb. 7, 2012

(54) LOCKING MOUNT SYSTEM FOR WEAPONS

(75) Inventors: Dave Carlson, Taylor Falls, MN (US); Jeff Holsclaw, St. Croix, WI (US)

(73) Assignee: Nobles Manufacturing, Inc., St. Croix Falls, WI (US)

( * ) Notice: Subject to any disclaimer, the term of this patent is extended or adjusted under 35 U.S.C. 154(b) by 284 days.

(21) Appl. No.: 12/361,286

(22) Filed: Jan. 28, 2009

(65) Prior Publication Data

US 2010/0186580 A1 Jul. 29, 2010

(51) Int. Cl.
*F41A 27/02* (2006.01)
*F41A 27/12* (2006.01)
*F41A 27/28* (2006.01)

(52) U.S. Cl. ..... 89/37.11; 89/41.01; 89/41.02

(58) Field of Classification Search ..... 89/37.02, 89/37.03, 41.01–41.22, 200–206; 73/167
See application file for complete search history.

(56) References Cited

U.S. PATENT DOCUMENTS

| | | | | |
|---|---|---|---|---|
| 628,840 | A | 7/1899 | Normand et al. | |
| 2,487,062 | A * | 11/1949 | Manes | 89/37.03 |
| 2,642,958 | A | 6/1953 | Lennon | |
| 3,424,052 | A | 1/1969 | Ruf | |
| 3,958,667 | A | 5/1976 | de Gennes | |
| 4,012,860 | A * | 3/1977 | Auger | 42/94 |
| 4,326,340 | A * | 4/1982 | Blomqvist et al. | 89/204 |
| 4,326,447 | A * | 4/1982 | Kauer et al. | 89/41.12 |
| 4,336,743 | A | 6/1982 | Horn et al. | |
| 4,379,501 | A | 4/1983 | Hagiwara et al. | |
| 4,508,007 | A | 4/1985 | Elspass | |
| 5,148,894 | A | 9/1992 | Eddy, Jr. | |
| 5,922,987 | A | 7/1999 | Hoffman et al. | |
| 5,949,015 | A * | 9/1999 | Smith et al. | 89/41.05 |
| 6,237,462 | B1 * | 5/2001 | Hawkes et al. | 89/41.05 |
| 7,021,188 | B1 * | 4/2006 | Berkovich et al. | 89/41.17 |
| 7,086,192 | B2 * | 8/2006 | Deros | 42/94 |
| 7,210,391 | B2 * | 5/2007 | Beckmann | 89/37.03 |
| 2004/0050240 | A1 * | 3/2004 | Greene et al. | 89/41.06 |
| 2006/0048642 | A1 * | 3/2006 | Beckmann | 89/37.03 |
| 2008/0053302 | A1 * | 3/2008 | Persson et al. | 89/41.01 |
| 2008/0110328 | A1 * | 5/2008 | Quinn | 89/200 |
| 2010/0126338 | A1 * | 5/2010 | Rastegar et al. | 89/37.13 |
| 2010/0269679 | A1 * | 10/2010 | Fisk et al. | 89/37.11 |

* cited by examiner

*Primary Examiner* — Bret Hayes
*Assistant Examiner* — Joshua Freeman
(74) *Attorney, Agent, or Firm* — Pauly, DeVries, Smith & Deffner, L.L.C.

(57) ABSTRACT

The invention relates to weapon mount systems that can be locked into a particular position. In an embodiment, the invention includes a weapon mount including a base structure; a mounting structure pivotably coupled to the base structure; a weapon cradle pivotably coupled to the mounting structure, the weapon cradle configured to hold a weapon. The weapon mount also includes a first locking mechanism configured to restrict pivoting of the weapon cradle relative to the mounting structure in a vertical plane, the first locking mechanism comprising a first brake caliper; and a first brake rotor, wherein the first brake caliper selectively engages the first brake rotor. The weapon mount also includes a second locking mechanism configured to restrict pivoting of the mounting structure relative to the base structure in a horizontal plane, the second locking mechanism comprising a second brake caliper; and a second brake rotor, wherein the second brake caliper selectively engages the second brake rotor. The weapon mount also includes a first control interface configured to actuate the first locking mechanism and a second control interface configured to actuate the second locking mechanism. Other embodiments are also included herein.

11 Claims, 6 Drawing Sheets

LOCKING MOUNT SYSTEM FOR WEAPONS

FIELD OF THE INVENTION

The invention relates to weapon mount systems. More specifically, the invention relates to weapon mount systems that can be locked into specific firing positions.

BACKGROUND OF THE INVENTION

Weapon mounts, such as gun mounts, can be used to secure weapons to fixed supports. Weapon mounts can free the operator of the weapon from physically supporting the weapon, which would be physically impossible in many situations because of the substantial weight of the weapon. Weapon mounts can include those where the muzzle of the weapon is permanently fixed in place, those where the muzzle of the weapon is intermittently fixed in place, and those where the muzzle of the weapon is freely movable in one or more planes to allow for aiming.

Some weapons systems, such as machine guns of a sufficient caliber, generate substantial recoil force during operation. It has been estimated, for example, that a 30 caliber machine gun may generate 1200 pounds of force or more with each round that is fired. Some of this force is directed vertically and can cause the muzzle to climb with each successive round fired, a phenomenon commonly known as "muzzle hop".

Skilled weapon operators can reposition the muzzle of a weapon after it has been disrupted by recoil. However, repositioning can take valuable time and the muzzle may not end up in the same place it started leading to errors in accuracy on follow-up shots.

Many targets are not stationary. In addition, the platform on which the weapon is carried, such as a humvee, tank, helicopter, or the like, is generally mobile. For these reasons, there is a need to frequently reposition the muzzle to stay aimed on a given target.

SUMMARY

The invention relates to weapon mount systems that can be locked into a particular position. In an embodiment, the invention includes a weapon mount including a base structure; a mounting structure pivotably coupled to the base structure; a weapon cradle pivotably coupled to the mounting structure, the weapon cradle configured to hold a weapon. The weapon mount also includes a first locking mechanism configured to restrict pivoting of the weapon cradle relative to the mounting structure in a vertical plane, the first locking mechanism comprising a first brake caliper; and a first brake rotor, wherein the first brake caliper selectively engages the first brake rotor. The weapon mount also includes a second locking mechanism configured to restrict pivoting of the mounting structure relative to the base structure in a horizontal plane, the second locking mechanism comprising a second brake caliper; and a second brake rotor, wherein the second brake caliper selectively engages the second brake rotor. The weapon mount also includes a first control interface configured to actuate the first locking mechanism and a second control interface configured to actuate the second locking mechanism.

In an embodiment, the invention includes a weapons system including a weapon comprising a muzzle; a base structure; a mounting structure pivotably coupled to the base structure; a weapon cradle pivotably coupled to the mounting structure, the weapon cradle configured to hold the weapon.

The weapons system also includes a first locking mechanism configured to restrict pivoting of the weapon cradle relative to the mounting structure and thereby restrict movement of the weapon muzzle in a vertical plane, the first locking mechanism comprising a first brake caliper; and a first brake rotor, wherein the first brake caliper selectively engages the first brake rotor. The weapons system also includes a second locking mechanism configured to restrict pivoting of the mounting structure relative to the base structure and thereby restrict movement of the weapon muzzle in a horizontal plane, the second locking mechanism comprising a second brake caliper; and a second brake rotor, wherein the second brake caliper selectively engages the second brake rotor. The weapons system also includes a first control interface configured to actuate the first locking mechanism; and a second control interface configured to actuate the second locking mechanism.

The above summary of the present invention is not intended to describe each discussed embodiment of the present invention. This is the purpose of the figures and the detailed description that follows.

BRIEF DESCRIPTION OF THE DRAWINGS

The invention may be more completely understood in connection with the following drawings, in which.

While the invention is susceptible to various modifications and alternative forms, specifics thereof have been shown by way of example and drawings and will be described in detail. It should be understood, however, that the invention is not limited to the particular embodiments described. On the contrary, the intention is to cover modifications, equivalents, and alternatives falling within the spirit and scope of the invention.

DETAILED DESCRIPTION OF THE INVENTION

There is frequently a need to reposition the muzzle of a weapon to stay aimed on a given target as the target moves, as the platform on which the weapon is mounted moves, or both. Yet, accuracy on follow-up shots can be enhanced by allowing the operator to lock the muzzle of the weapon in a specific position. Accommodating both the need to reposition a muzzle and the need to selectively lock it into position can present a substantial challenge.

Embodiments of weapon mounts herein can allow the operator of a weapon to reposition the muzzle while also allowing them to selectively and quickly lock the muzzle in a specific desired position. For example, the weapon mount can include a first locking mechanism configured to restrict pivoting of a muzzle in a vertical plane and a second locking mechanism configured to restrict pivoting of the muzzle in a horizontal plane. The first locking mechanism and the second locking mechanism can be separately engaged or disengaged by the weapon operator so that vertical alignment of the muzzle can be adjusted even when the horizontal alignment of the muzzle is locked. Conversely, the horizontal alignment of the muzzle can be adjusted even when the vertical alignment of the muzzle is locked. In various embodiments, the locking mechanisms can be a braking mechanism, such as a disk brake type mechanism. Various aspects of exemplary embodiments will now be described in greater detail.

Figure 1:
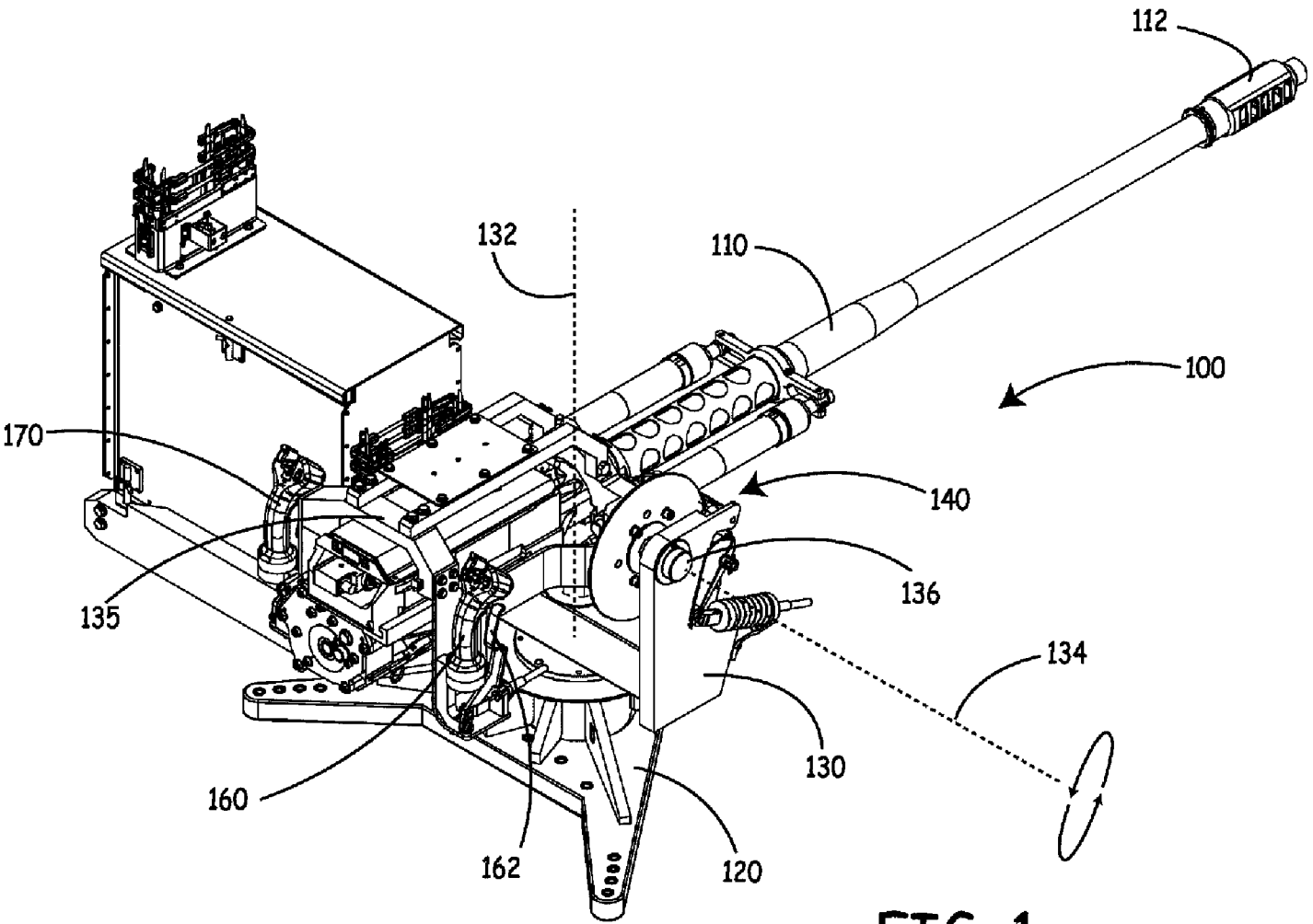
FIG. 1 is an isometric view of a weapon mount system consistent with at least one embodiment of the technology disclosed herein.

FIG. 1 is an isometric view of a system consistent with at least one embodiment of the technology disclosed herein. The weapon system 100 includes a base structure 120, a mounting structure 130 coupled to the base structure 120, a weapon cradle 135 coupled to the mounting structure 130, a weapon 110 coupled to the weapon cradle 135, a first locking mechanism 140, and a second locking mechanism (not shown in FIG. 1).

The base structure 120 is generally configured to provide support for the weapon system 100. The base structure 120 is configured to accommodate a variety of surfaces on which the weapon system 100 may be mounted for use such as on vehicles, terrain having varying surface features, and the like. The base structure 120 is generally constructed of a durable material such as a metal, ceramic, or a composite, that can withstand forces exerted by the weapon system 100. In some embodiments, the base structure 120 is constructed of aluminum or steel.

The base structure 120 can be configured to be attached to other equipment in a variety of ways. For example, the base structure 120 can define openings that are configured to receive bolts, screws, rivets, or the like.

In a variety of embodiments, the mounting structure 130 is pivotably coupled to the base structure 120. In one embodiment the mounting structure 130 pivots relative to the base structure 120 so that the weapon 110 can be pivoted in a substantially horizontal plane. For example, the mounting structure 130 can move about first pivot axis 132 with respect to the base structure 120. In some embodiments, the mounting structure 130 can include a shaft or axle (not shown) that passes through an aperture in the base structure 120, allowing the mounting structure 130 to pivot relative to the base structure 120. However, many different structural configurations are contemplated herein.

In a variety of embodiments, the weapon cradle 135 is pivotably coupled to the mounting structure 130. In one embodiment, the weapon cradle 135 pivots relative to the mounting structure 130 so that the weapon 110 can be moved in a substantially vertical plane. For example, the weapon cradle 135 can move about second pivot axis 134 with respect to the mounting structure 130. In some embodiments, the weapon cradle 135 can include a shaft 136 or axle that passes through an aperture in the mounting structure 130, allowing the weapon cradle 135 to pivot relative to the mounting structure 130.

The weapon 110 can be one of a variety of different weapons known to those of skill in the art. Generally the weapon 110 can be configured to be operated after being positioned (aimed) relative to a target. The weapon 110 can have a muzzle 112 in at least one embodiment, but such is not necessary for practicing the technology disclosed herein.

In one particular embodiment the weapon is a machine gun. Exemplary weapons can include, but are not limited to, the M230LF 30 mm (ATK in Minneapolis, Minn., USA), MK-19 40 mm automatic grenade launcher ("AGL") (General Dynamics Armament and Technical Products in Charlotte, N.C., USA), MK-47 40 mm AGL (General Dynamics Armament and Technical Products in Charlotte, N.C., USA), M2HB .50 Cal Heavy Machinegun (TNW Firearms, Inc. in Vernonia, Oreg.), and M134D 7.62 mm Mini-Gun (Dillon Aero, Inc., Scottsdale, Ariz.).

The first locking mechanism 140 is configured to restrict pivoting of the weapon cradle 135 relative to the mounting structure 130. The first locking mechanism 140 can be controlled (actuated) through a first control interface 160. In some embodiments, the first locking mechanism 140 is engaged by default, locking the muzzle 112 of the weapon in position vertically. However, through user manipulation of the first control interface 160, the first locking mechanism 140 can be disengaged, which allows pivoting of the weapon cradle 135 relative to the mounting structure 130. In the current embodiment, the first control interface 160 has a control lever 162 which can be manipulated in order to engage or disengage the first locking mechanism 140.

The second locking mechanism (not shown in FIG. 1) is configured to restrict pivoting of the mounting structure 130 relative to the base structure 120. The second locking mechanism can be controlled (actuated) through a second control interface 170. In some embodiments, the second locking mechanism is engaged by default, locking the muzzle 112 of the weapon in position horizontally. However, through user manipulation of the second control interface 170, the second locking mechanism 150 can be disengaged, which allows pivoting of the mounting structure 130 relative to the base structure 120. In the current embodiment, the second control interface 170 has a second control lever (not shown in FIG. 1) which can be manipulated in order to engage or disengage the second locking mechanism.

Figure 2:
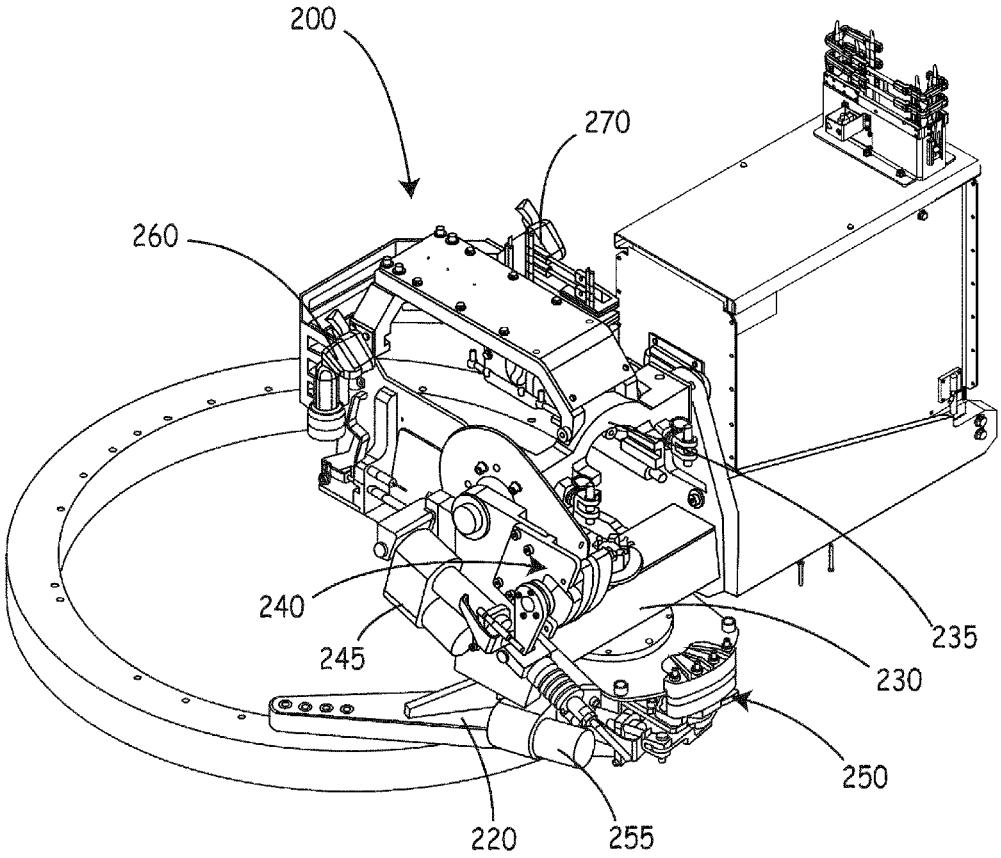
FIG. 2 is an isometric view of a weapon mount system consistent with at least one embodiment of the technology disclosed herein.

FIG. 2 is an isometric view of a weapon mount 200 without a weapon consistent with at least one embodiment of the technology disclosed herein. The weapon mount 200 has a base structure 220, a mounting structure 230 coupled to the base structure 220, a weapon cradle 235 coupled to the mounting structure 230, a first locking mechanism 240 having a first control interface 260, and a second locking mechanism 250 having a second control interface 270.

In this embodiment, the first control interface 260 can be used to engage or disengage first locking mechanism 240. In some embodiments, the linkage between first control interface 260 and first locking mechanism 240 can be purely mechanical, such as a control cable or wire. In other embodiments, a power assist device, such as power actuator 245, can be used. In some embodiments the power actuator 245 can include a hydraulic cylinder. In some embodiments the power actuator 245 can include an electric motor. Power actuator 245 can be controlled by first control interface 260. While not intending to be bound by theory, the use of a power assist device can be advantageous because it can reduce the amount of physical force that a user must exert at the first control interface 260 (such as on a lever or trigger) in order to engage or disengage the first locking mechanism 240.

Similarly, second control interface 270 can be used to engage or disengage second locking mechanism 250. In some embodiments, the linkage between second control interface 270 and second locking mechanism 250 can be purely mechanical, such as a control cable or wire. In other embodiments, a power assist device, such as power actuator 255, can be used.

In at least one embodiment, the first locking mechanism 240 and the second locking mechanism 250 utilize a disk brake-type mechanism. The disk brake-type mechanism can include a brake rotor and a brake caliper that engages with the brake rotor.

Figure 3:
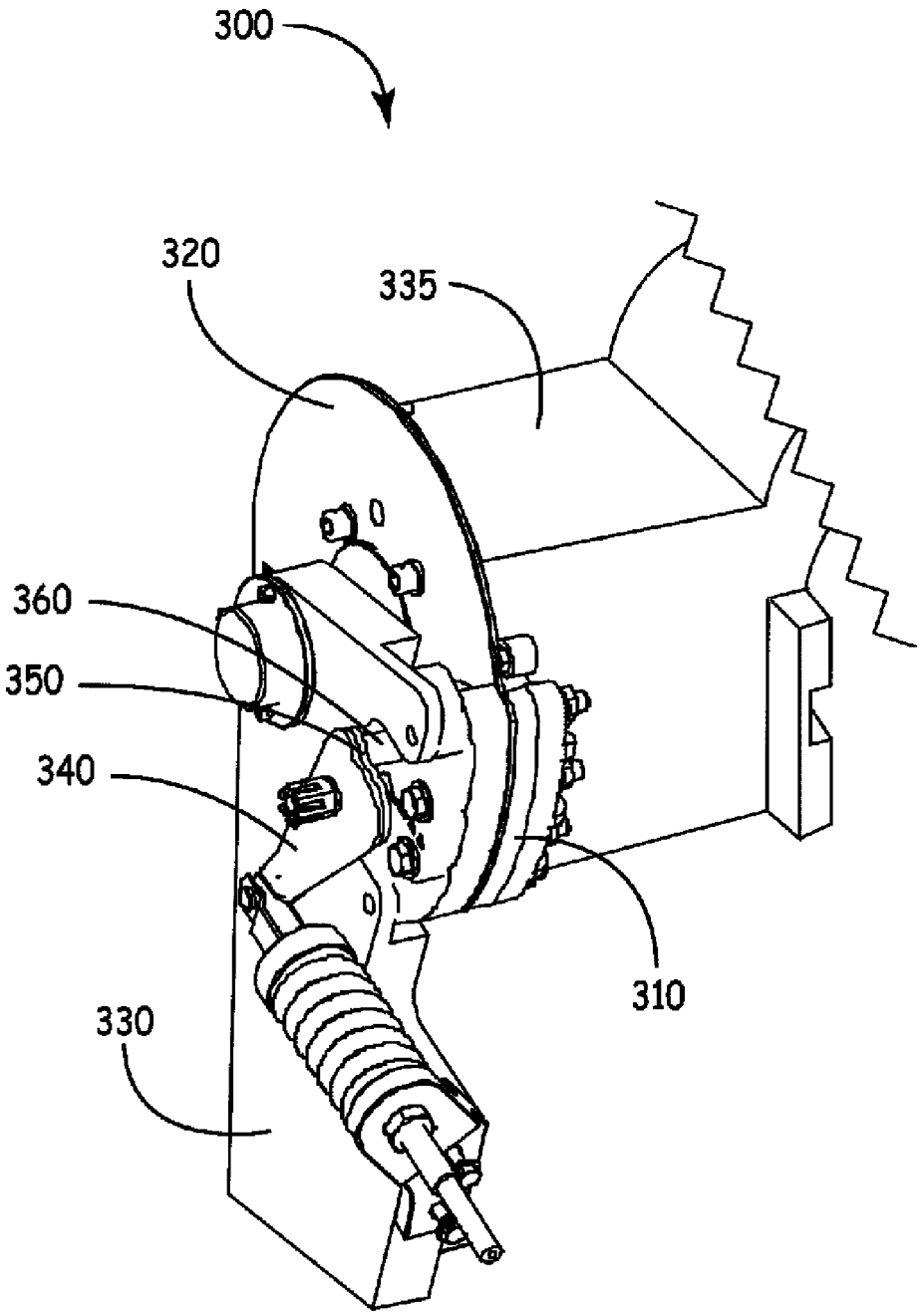
FIG. 3 is a schematic view of a locking mechanism consistent with at least one embodiment of the technology disclosed herein.

FIG. 3 is a view of a locking mechanism consistent with at least one embodiment of the technology disclosed herein. The locking mechanism 300 is consistent with a "first" locking mechanism as shown in FIG. 1 and FIG. 2. It will be appreciated that the second locking mechanism as shown in FIG. 2 is generally similar to the first locking mechanism, except the second locking mechanism restricts pivoting of the mounting structure relative to the base structure, whereas the first locking mechanism restricts pivoting of the weapon cradle relative to the mounting structure.

The locking mechanism 300 includes a brake caliper 310 in mechanical communication with a brake rotor 320. Within the brake caliper 310 is one or more brake pads (not shown). The locking mechanism 300 also includes a crank arm 340, a cam 350, and a piston 360.

The brake pads within the caliper are configured to frictionally engage the brake rotor 320 when the first control interface (not shown) is disengaged (e.g., control lever is not being pulled by the weapon operator). There can be one brake pad or multiple brake pads. The brake pad(s) 508, 510 can be constructed of a variety of materials generally known in the art, including but not limited to ceramic, glass, steel and/or copper fibers, plastics, and the like. In one embodiment the brake pads are constructed of carbon graphite material. The brake pads can have a variety of configurations consistent with what is known in the art. Exemplary configurations for calipers including brake pads can be found in U.S. Pat. No. 3,958,667, U.S. Pat. No. 4,379,501, and U.S. Pat. No. 5,148,894, the content of which is herein incorporated by reference in its entirety.

The crank arm 340 is configured to be controlled by the first control interface (not shown). The crank arm 340 can be pivotably disposed on the mounting structure 330 such that when actuated by the first control interface, the crank arm 340 pivots. The cam 350 is coupled to an end of the crank arm 340. When the crank arm 340 pivots, the cam 350 moves with the end of the crank arm 340, and slides against the end of the piston 360, causing the piston 360 to move. Movement of the piston 360, in turn, can cause the brake pads within the caliper 310 to contact the surface of the brake rotor 320, preventing movement of the brake rotor 320 relative to the brake caliper.

Figure 4:
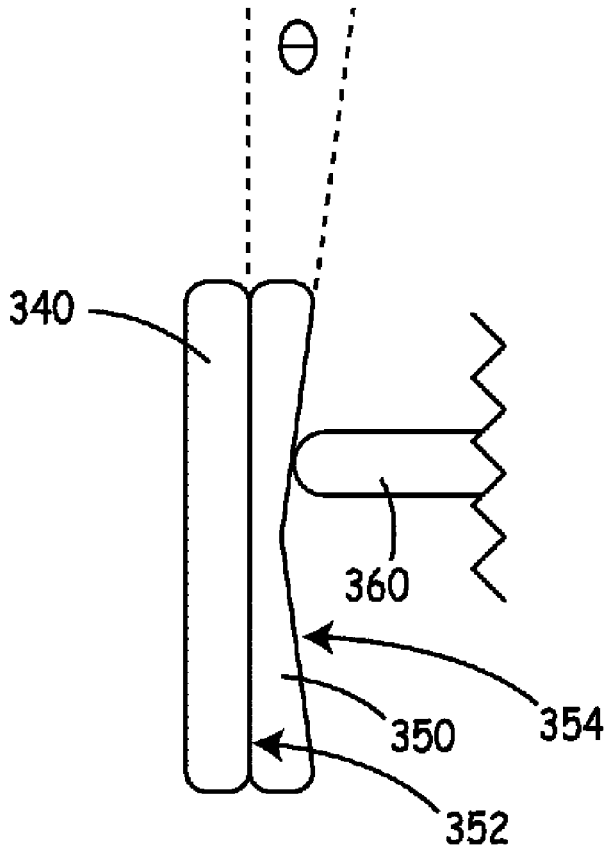
FIG. 4 is a schematic view of a portion of a locking mechanism in accordance with at least one embodiment of the technology disclosed herein.

Referring now to FIG. 4, a schematic view of the interface between the end of the crank arm 340, the cam 350, and the piston 360 is shown. The cam 350 defines a first side 352 that is coupled to the crank arm 340. The cam 350 also defines a second side 354 that defines a ramped surface. In at least one embodiment the ramped surface has a ramp angle □ of at least about 15 degrees. The ramp angle can be determined relative to the flat first side 352. The larger the ramp angle, the less movement of the crank arm is required to cause the piston to move significantly enough to cause a braking action between the brake pads and the rotor. In some embodiments, the ramp angle is at least about 20 degrees. In some embodiments, the ramp angle is at least about 25 degrees.

Figure 5:
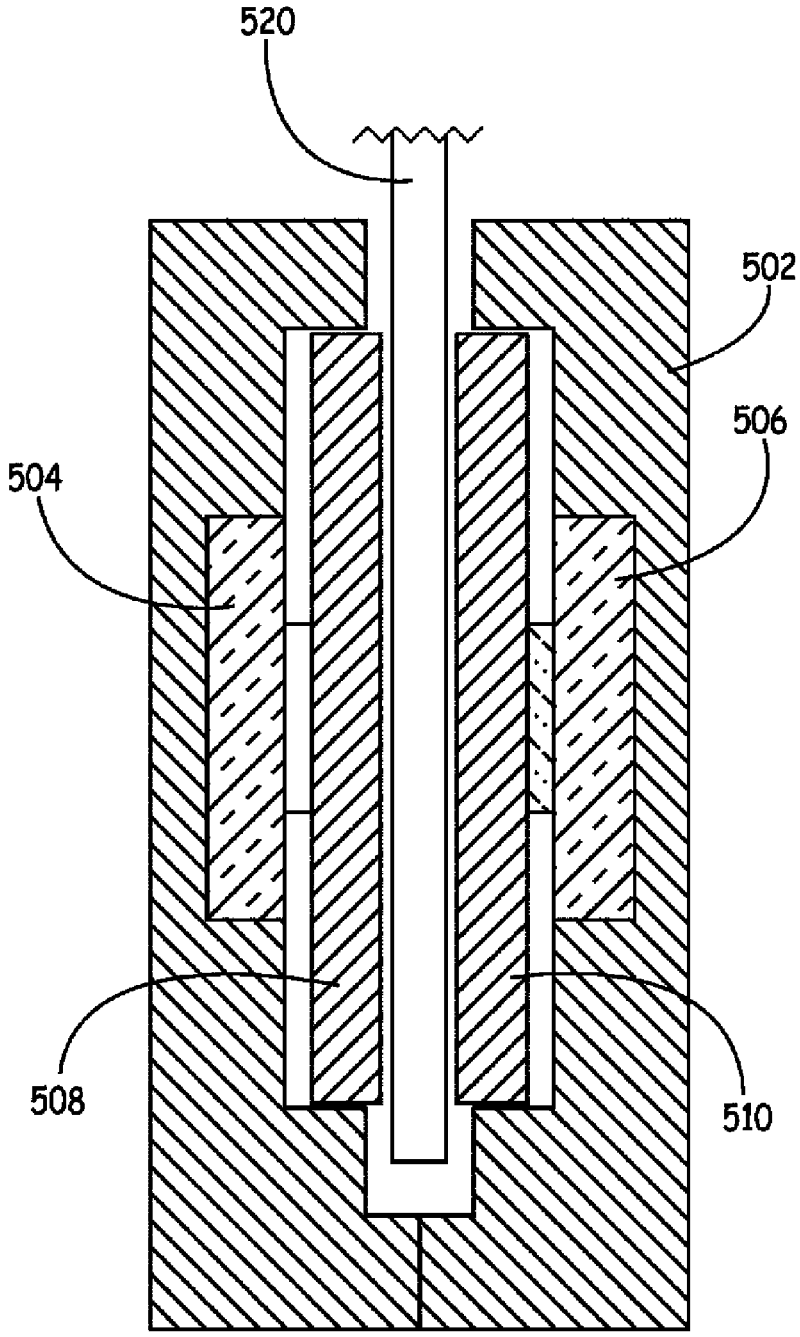
FIG. 5 is a schematic view of portions of a caliper in accordance with at least one embodiment of the technology disclosed herein.

FIG. 5 shows a schematic view of an exemplary caliper. The caliper can include a caliper housing 502. Within the caliper housing 502 are brake pads 508, 510. Brake pads 508, 510 can be moved by actuators 504, 506. Brake pads 508, 510 can engage the surface of brake rotor 520. It will be appreciated that a piston, such piston 360 in FIG. 4, can be directly or indirectly coupled with the caliper in order to initiate movement of the brake pads 508, 510. For example, the caliper can include a mechanical, electrical, and/or hydraulic linkage between the piston and actuators 504, 506 in order to cause brake pads 508,510 to engage the brake rotor 520. Many different specific configurations are contemplated herein. In some embodiments, the caliper may include only a single brake pad. In other embodiments, the caliper may include two or more brake pads.

Figure 6:
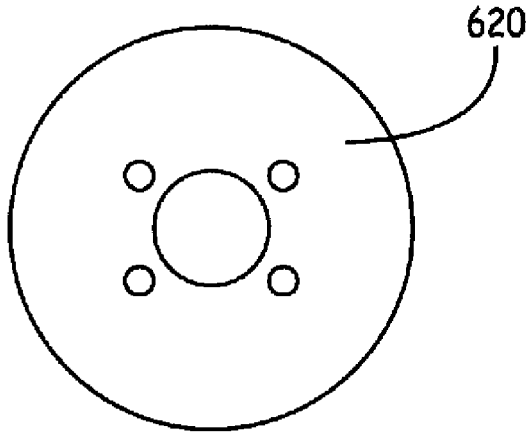
FIG. 6 is a schematic view of a brake rotor in accordance with at least one embodiment of the technology disclosed herein.
Figure 7:
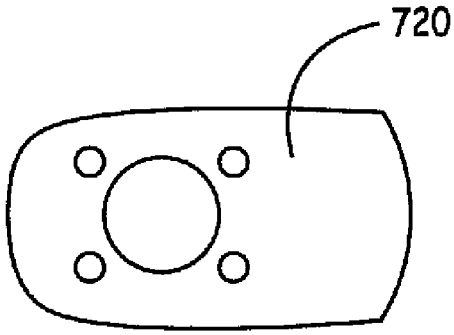
FIG. 7 is a schematic view of a brake rotor in accordance with at least one embodiment of the technology disclosed herein.

It will be appreciated that the brake rotor can take on a variety of shapes in accordance with embodiments herein. Referring now to FIG. 6, in one embodiment the brake rotor 620 is a disk that is substantially circular. However, the brake rotor may take on various other shapes. Referring now to FIG. 7, in one embodiment the brake rotor 720 defines only a portion of a disk. For example, the brake rotor 720 can have a circumference that is non-circular. While not intending to be bound by theory, it is believed that formation of the brake rotor in a shape that is less than a full circle can be advantageous because there less physical obstruction with the view of the weapon operator and with other parts of the gun mount system. Moreover, since the brake rotor in this embodiment rotates significantly less than 360 degrees through the brake caliper when the gun mount is in operation, it is not necessary to have a fully circular brake rotor. The brake rotor can be constructed of a variety of materials including, but not limited to, various types of metals, ceramics, and composites.

It should be noted that, as used in this specification and the appended claims, the singular forms "a", "an", and "the" include plural referents unless the content clearly dictates otherwise. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, adapted, constructed, manufactured and arranged, and the like.

The invention has been described with reference to various specific embodiments and techniques. However, it should be understood that many variations and modifications may be made while remaining within the spirit and scope of the invention.

The invention claimed is:

1. A weapon mount comprising:

a base structure;

a mounting structure pivotably coupled to the base structure;

a weapon cradle pivotably coupled to the mounting structure, the weapon cradle configured to hold a weapon;

a first locking mechanism configured to restrict pivoting of the weapon cradle relative to the mounting structure in a vertical plane, and a first control interface configured to actuate the first locking mechanism, the first locking mechanism comprising a first brake caliper;

a first brake rotor, wherein the first brake caliper selectively engages the first brake rotor;

one or more brake pads configured to engage the first brake rotor;

a first crank arm configured to be actuated by the first control interface, a first cam comprising a first side coupled to the first crank arm and a second side comprising a ramped surface, and a first piston configured to contact the ramped surface of the first cam, the first piston configured to cause movement of the brake pads into contact with the first brake rotor when the first crank arm rotates causing the ramped surface of the first cam to slide against the first piston;

a second locking mechanism configured to restrict pivoting of the mounting structure relative to the base structure in a horizontal plane, and a second control interface configured to actuate the second locking mechanism, the second locking mechanism comprising a second brake caliper; and a second brake rotor, wherein the second brake caliper selectively engages the second brake rotor; and one or more brake pads configured to engage the second brake rotor.

2. The weapon mount of claim 1, the first locking mechanism configured to prevent movement of the first brake caliper relative to the first brake rotor when the first control interface is disengaged.

3. The weapon mount of claim 1, the second locking mechanism configured to prevent movement of the second brake caliper relative to the second brake rotor when the second control interface is disengaged.

4. The weapon mount of claim 1, wherein the first brake rotor has a non-circular circumference.

5. The weapon mount of claim 1, the ramped surface of the first cam comprising of ramp angle of at least about 15 degrees.

6. The weapon mount of claim 1, further comprising a first powered actuator unit configured to reduce the force required for the first control interface to actuate the first locking mechanism.

7. The weapon mount of claim 1, the base structure configured to be attached to a mobile platform.

8. The weapon mount of claim 1, the second locking mechanism further comprising a second crank arm configured to be actuated by the second control interface, a second cam comprising a first side coupled to the second crank arm and a second side comprising a ramped surface, and a second piston configured to contact the ramped surface of the second cam, the second piston configured to cause movement of the brake pads into contact with the second brake rotor when the second crank arm rotates causing the ramped surface of the second cam to slide against the second piston.

9. The weapon mount of claim 8, the ramped surface of the second cam comprising of ramp angle of at least about 15 degrees.

10. The weapon mount of claim 8, further comprising a second powered actuator unit configured to reduce the force required for the second control interface to actuate the second locking mechanism.

11. A weapon mount comprising:

a base structure;

a mounting structure pivotably coupled to the base structure;

a weapon cradle pivotably coupled to the mounting structure, the weapon cradle configured to hold a weapon;

a first locking mechanism configured to restrict pivoting of the weapon cradle relative to the mounting structure in a vertical plane, and a first control interface configured to actuate the first locking mechanism, the first locking mechanism comprising a first brake caliper;

a first brake rotor, wherein the first brake caliper selectively engages the first brake rotor;

one or more brake pads configured to engage the first brake rotor;

a second locking mechanism configured to restrict pivoting of the mounting structure relative to the base structure in a horizontal plane, and a second control interface configured to actuate the second locking mechanism, the second locking mechanism comprising a second brake caliper; and a second brake rotor, wherein the second brake caliper selectively engages the second brake rotor; and one or more brake pads configured to engage the second brake rotor a second crank arm configured to be actuated by the second control interface, a second cam comprising a first side coupled to the second crank arm and a second side comprising a ramped surface, and a second piston configured to contact the ramped surface of the second cam, the second piston configured to cause movement of the brake pads into contact with the second brake rotor when the second crank arm rotates causing the ramped surface of the second cam to slide against the second piston.

* * * * *